US012234424B2

(12) United States Patent
Catanach et al.

(10) Patent No.: US 12,234,424 B2
(45) Date of Patent: Feb. 25, 2025

(54) HYDROCARBON COMPOSITIONS USEFUL AS LUBRICANTS FOR IMPROVED OXIDATION STABILITY

(71) Applicant: EXXONMOBIL TECHNOLOGY AND ENGINEERING COMPANY, Annandale, NJ (US)

(72) Inventors: Joshua D. Catanach, Bridgewater, NJ (US); Clara Rodrigue, Philadelphia, PA (US); Christine A. Zielinski, Furlong, PA (US); Charles L. Baker, Jr., Thornton, PA (US); Richard C. Dougherty, Moorestown, NJ (US); Min Chen, Clinton, NJ (US)

(73) Assignee: Exxon Mobil Technology and Engineering Company, Spring, TX (US)

( * ) Notice: Subject to any disclaimer, the term of this patent is extended or adjusted under 35 U.S.C. 154(b) by 97 days.

(21) Appl. No.: 17/915,279

(22) PCT Filed: Feb. 12, 2021

(86) PCT No.: PCT/US2021/017788
§ 371 (c)(1),
(2) Date: Sep. 28, 2022

(87) PCT Pub. No.: WO2021/225662
PCT Pub. Date: Nov. 11, 2021

(65) Prior Publication Data

US 2023/0132628 A1 May 4, 2023

Related U.S. Application Data

(60) Provisional application No. 63/003,135, filed on Mar. 31, 2020.

(51) Int. Cl.

| | |
|---|---|
| ***C10M 169/04*** | (2006.01) |
| ***C10G 67/04*** | (2006.01) |
| *C10N 20/00* | (2006.01) |
| *C10N 20/02* | (2006.01) |
| *C10N 30/00* | (2006.01) |
| *C10N 30/10* | (2006.01) |

(52) U.S. Cl.
CPC ..... *C10M 169/04* (2013.01); *C10G 67/0445* (2013.01); *C10M 2205/0285* (2013.01); *C10N 2020/02* (2013.01); *C10N 2020/071* (2020.05); *C10N 2030/10* (2013.01); *C10N 2030/74* (2020.05)

(58) Field of Classification Search
CPC ..... C10M 169/04; C10M 2205/0285; C10M 2203/1025; C10M 2219/00; C10M 2219/102; C10M 101/02; C10M 171/00; C10G 67/0445; C10G 21/00; C10G 47/00; C10N 2020/071; C10N 2030/10; C10N 2030/40; C10N 2030/43
USPC ..... 208/18
See application file for complete search history.

(56) References Cited

U.S. PATENT DOCUMENTS

| | | | | |
|---|---|---|---|---|
| 3,382,291 | A | 5/1968 | Brennan et al. | |
| 3,742,082 | A | 6/1973 | Brennan | |
| 3,769,363 | A | 10/1973 | Brennan et al. | |
| 3,876,720 | A | 4/1975 | Heilman et al. | |
| 3,992,307 | A * | 11/1976 | Hotten | C10M 141/10 508/495 |
| 4,149,178 | A | 4/1979 | Estes | |
| 4,239,930 | A | 12/1980 | Allphin et al. | |
| 4,367,352 | A | 1/1983 | Watts, Jr. et al. | |
| 4,413,156 | A | 11/1983 | Watts, Jr. et al. | |
| 4,434,408 | A | 2/1984 | Baba et al. | |
| 4,827,064 | A | 5/1989 | Wu | |
| 4,827,073 | A | 5/1989 | Wu | |
| 4,910,355 | A | 3/1990 | Shubkin et al. | |
| 4,956,122 | A | 9/1990 | Watts et al. | |
| 5,068,487 | A | 11/1991 | Theriot | |
| 7,704,930 | B2 | 4/2010 | Deckman et al. | |
| 2009/0149357 | A1 * | 6/2009 | McGeehan | C10M 171/02 508/110 |
| 2010/0323936 | A1 | 12/2010 | Ames et al. | |

FOREIGN PATENT DOCUMENTS

WO 2020011948 A1 1/2020

OTHER PUBLICATIONS

Yuanqing, Gao. Effect of Sulfur-Containing Compounds On The Oxidation Process of Daqing Medium Lube Oil. Jingcheng, Zhang. Changning, Han. Research Institute of Petroleum Processing, Dec. 1986. PDF file. 10 pages. Google English Machine Translation.
Journal of the Society of Tribologists and Lubrication Engineers, V. J. Gatto, et al., Effects of Base Oil Type, Oxidation Test Conditions and Phenolic Antioxidant Structure on the Detection and Magnitude of Hindered Phenol/ Diphenylamine Synergism, 1999.
Lube-Tech, Norrby, et al., Oxidation stability and base oil sulphur, a dynamic relationship of additive response factors, 2018.
Journal of Synthetic Lubrication, Jaroslav Cerny, et al., Composition and Oxidative Stability of Hydro-cracked Base Oils and Comparison with a PAO, Oct. 2001.
Yuanqing Gao, Effect of sulfur-containing compounds on the oxidation process of daqing medium lube oil, Jingcheng, Jan. 1986.

(Continued)

*Primary Examiner* — Prem C Singh
*Assistant Examiner* — Francis C Campanell
(74) *Attorney, Agent, or Firm* — C. Tumey Law Group PLLC

(57) ABSTRACT

Provided herein are hydrocarbon compositions suitable for use as a lubricant comprising sulfur between about 30 ppm to about 220 ppm, and aromatics between about 0.2 wt. % to about 3 wt. %. The present hydrocarbon compositions comprise a blend of one or more base stocks and a high-sulfur containing material and can demonstrate an improved oxidation performance as a lubricant in weighted piston deposit merits and/or by viscosity increase.

14 Claims, No Drawings

(56) References Cited

OTHER PUBLICATIONS

International Search Report and Written Opinion for PCT/US2021/017788 dated Sep. 11, 2021.
Lubricant Additives, Chemistry and Applications, Ed. L. R. Rudnick, Marcel Dekker, Inc. 270 Madison Ave., New York, N.J. 10016, 2003.

* cited by examiner

HYDROCARBON COMPOSITIONS USEFUL AS LUBRICANTS FOR IMPROVED OXIDATION STABILITY

FIELD OF THE INVENTION

The present invention relates to novel hydrocarbon compositions with improved oxidative stability, methods of preparing the compositions and methods of using the compositions as base stocks, base oils, lubricants, fluids, process oils and the like.

BACKGROUND OF THE INVENTION

Oxidation is a chemical reaction that occurs with the combination of a composition such as a lubricant oil and oxygen. The rate of oxidation is accelerated by high temperatures, water, acids and catalyst. Oxidation can lead to an increase in viscosity of the lubricant and piston deposits such as sludge and varnish. Moreover, an increase in sulfur and aromatics in a lubricant base stock can negatively impact oxidation performance. In short, high levels of sulfur and aromatics can be harmful to oxidative stability of a lubricant.

Often the rate of oxidation is dependent on the quality of the lubricant base oil as well as the additive package. Oxidation stability, however, is important as oxidation reduces the service life of a lubricant.

SUMMARY OF THE INVENTION

According to an embodiment, the present invention provides hydrocarbon compositions comprising about 30 ppm to about 220 ppm of sulfur, about 0.2 wt. % to about 3 wt. %, about 27.8 wt. % to about 99.7 wt. % of paraffins, and about 0 to about 63.9 wt. % of naphthenes, analyzed according to the procedure in Analytical Chemistry, 64:2227 (1992), the disclosure of which is hereby incorporated by reference, to determine the type of paraffins, naphthenes, and aromatics in the oil, wherein the hydrocarbon compositions demonstrate an increase in weighted piston deposit merits over a hydrocarbon composition having the same amount of paraffins and naphthenes and less than 30 ppm of sulfur and less than 0.2 wt. % aromatics.

In a further embodiment, the present invention provides hydrocarbon compositions comprising about 30 ppm to about 220 ppm sulfur, and about 0.2 wt. % to about 3 wt. % of aromatics, wherein the hydrocarbon compositions demonstrated an improvement in lubricant oxidation stability over a hydrocarbon composition having the same amount of paraffins and naphthenes and less than 30 ppm of sulfur and less than 0.2 wt. % aromatics.

In a further embodiment of the present invention, a hydrocarbon composition comprises a blend of one or more base stocks and a high-sulfur containing material, wherein one or more base stocks have a kinematic viscosity at 100° C. of between about 3.0 cSt and about 12.0 cSt, a viscosity index between about 80 and about 150, a pour point between about −15° C. and −60° C., a NOACK volatility between about 5.0 wt. % and 15.0 wt. %, a sulfur content between about 0 ppm and 100 ppm, aromatics in an amount less than 3.0 wt. %, and an NMR branching index between about 20.6 and 38.3, and the high-sulfur containing material comprises between about 0.01 wt. % to about 4.5 wt. % sulfur, or between about 0.5 wt. % to about 3 wt. % sulfur. In further aspects of the invention, the high-sulfur containing material comprises between about 3 wt. % to about 75 wt. % aromatics, or about 10 wt. % to about 60 wt. % aromatics, as measured by ASTM D7419. In another aspect of the invention, the high-sulfur containing material comprises aromatics having an amount and distribution as determined by ultraviolet (UV) spectroscopy absorptivity of less than about 37.9 l/g-cm@wavelengths between about 254 nm and about 325 nm as determined by ultraviolet ("UV") spectroscopy absorptivity of less than about 37.9 l/g-cm@wavelengths. In an aspect, the base stock comprises sulfur between about 30 ppm to about 220 ppm and aromatics between about 0.2 wt. % to about 3 wt. %. In an aspect, the hydrocarbon composition has a viscosity increase at 100° C. between about 0.10% and 29% and a weighted piston deposit between about 4.17 to about 4.85 merits, both the viscosity increase and the weighted piston deposit measured by ASTM D8111 (Sequence IIIH Test).

In a further embodiment, the present invention provides methods for preparing hydrocarbon compositions by various processes such as a separation process, a conversion process and/or a blending process. In an aspect, the conversion process is catalytic hydrocracking or hydrotreating. In an aspect, the separation process includes the step of solvent extraction. In an aspect, separation is performed using membranes. In an aspect, the present hydrocarbon compositions comprise sulfur such as heterocyclic sulfur compounds comprising thiophene and/or its higher homologs and analogs or combinations thereof.

In a further embodiment of the invention, methods are provided to produce a hydrocarbon composition by controlling the amounts of sulfur and/or aromatics in the hydrocarbon composition through various methods such as separation, conversion, hydroprocessing and/or combining base stocks with high-sulfur containing compositions.

DETAILED DESCRIPTION OF THE INVENTION

Before the present compounds, components, compositions, and/or methods are disclosed and described, it is to be understood that unless otherwise indicated this disclosure is not limited to specific compounds, components, compositions, reactants, reaction conditions, ligands, catalyst structures, metallocene structures, or the like, as such may vary, unless otherwise specified. It is also to be understood that the terminology used herein is for the purpose of describing particular aspects only and is not intended to be limiting.

All numerical values within the detailed description and the claims herein are modified by "about" or "approximately" the indicated value, taking into account experimental error and variations.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, within a range includes every point or individual value between its end points even though not explicitly recited. Thus, every point or individual value may serve as its own lower or upper limit combined with any other point or individual value or any other lower or upper limit, to recite a range not explicitly recited.

For the purposes of this disclosure, the following definitions will apply:

For purposes of this invention and the claims hereto, the numbering scheme for the Periodic Table Groups is according to the IUPAC Periodic Table of Elements as of Jan. 1, 2020.

The term "and/or" as used in a phrase such as "A and/or B" herein is intended to include "A and B", "A or B", "A", and "B".

As used herein, the term "alpha-olefin" refers to an olefin having a terminal carbon-to-carbon double bond ($(R_1R_2)$—C═$CH_2$) in the structure thereof.

As used herein, the term "aromatic" refers to unsaturated hydrocarbons comprising an aromatic ring in structures thereof, the aromatic ring having a delocalized conjugated .pi. system and having from 4 to 20 carbon atoms. The aromatic ring can comprise one or more heteroatoms. Examples of heteroatoms include, but are not limited to, nitrogen, oxygen, and/or sulfur. Aromatics with one or more heteroatom in the aromatic ring therein include, but are not limited to furan, benzofuran, thiophene, benzothiophene, oxazole, thiazole and the like, and combinations thereof. The aromatic ring can be monocyclic, bicyclic, tricyclic, and/or polycyclic (in some embodiments, at least monocyclic rings, only monocyclic and bicyclic rings, or only monocyclic rings) and can be fused rings. Exemplary aromatics include, but are not limited to benzene, toluene, xylenes, mesitylene, ethylbenzenes, cumene, naphthalene, methylnaphthalene, dimethylnaphthalenes, ethylnaphthalenes, acenaphthalene, anthracene, phenanthrene, tetraphene, naphthacene, benzanthracenes, fluoranthene, pyrene, chrysene, triphenylene, and the like, and combinations thereof. The aromatic can optionally be substituted, e.g., with one or more alkyl group, alkoxy group, halogen, etc. Aromatics can be measured by one or more of several methods, including supercritical fluid chromatography (ASTM D5186), high-pressure liquid chromatography (HPLC) (ASTM D6379), chromatography over alumina/silica gel (ASTM D2549), preparative chromatography (ASTM D2007), and ultraviolet (UV) spectroscopy.

The term "base stock" is a lubricant component that is produced by a single manufacturer to the same specifications (independent of feed source or manufacturer's location), meets the same manufacturer's specification, and is identified by a unique formula, product identification number or both. American Petroleum Institute (API) 1509, Engine Oil Licensing and Certification System, $15^{th}$ ed., April 2002, Appendix E. API Base Oil Interchangeability Guidelines for Passenger Cr Motor Oils and Diesel Engine Oils, 2004, Section E.1.2, Definitions (Washington, DC: American Petroleum Institute).

The term a "base stock slate" refers to a product line of base stocks that have different viscosities, the base stocks of a base stock slate are in the same base stock grouping and from the same manufacturer. Alternatively, the term "slate" refers to a group of base stocks from a lube process that differ in viscosities.

Unless otherwise specified, the term "hydrocarbon" refers to a class of compounds containing hydrogen bound to carbon, and encompasses (i) saturated hydrocarbon compounds, (ii) unsaturated hydrocarbon compounds, and (iii) mixtures of hydrocarbon compounds (saturated and/or unsaturated), including mixtures of hydrocarbon compounds having different values of n.

As used herein, a "lubricant" refers to a substance that can be introduced between two or more moving surfaces and lowers the level of friction between two adjacent surfaces moving relative to each other.

As used herein, an "olefin" refers to an unsaturated hydrocarbon compound having a hydrocarbon chain containing at least one carbon-to-carbon double bond in the structure thereof, wherein the carbon-to-carbon double bond does not constitute a part of an aromatic ring. The olefin can be straight-chain, branched-chain or cyclic. "Olefin" is intended to embrace all structural isomeric forms of olefins, unless it is specified to mean a single isomer or the context clearly indicates otherwise.

As used herein, a "polyalpha-olefin(s)" ("PAO(s)") includes any oligomer(s) and polymer(s) of one or more alpha-olefin monomer(s). Thus, the PAO can be a dimer, a trimer, a tetramer, or any other oligomer or polymer comprising two or more structure units derived from one or more alpha-olefin monomer(s). The PAO molecule can be highly regio-regular, such that the bulk material exhibits an isotacticity, or a syndiotacticity when measured by 13C NMR. The PAO molecule can be highly regio-irregular, such that the bulk material is substantially atactic when measured by 13C NMR. A PAO material made by using a metallocene-based catalyst system is typically called a metallocene-PAO ("mPAO"), and a PAO material made by using traditional non-metallocene-based catalysts (e.g., Lewis acids, supported chromium oxide, and the like) is typically called a conventional PAO ("cPAO").

As used herein, the term "viscosity index" or "VI" is a measure of the extent of viscosity change with temperature; the higher the VI, the less change, and generally speaking, higher VIs are preferred. VI is usually calculated from measurements at 40° C. and 100° C. The minimum VI for a paraffinic base stock is typically between about 80 and about 95, as established by automotive market needs. Naphthenic base stocks may have VIs around zero. The conventional solvent extraction/solvent dewaxing route produces base stocks with VIs of about 95. Lower raffinate yields (higher extract yields) in solvent refining mean higher VIs, but it is difficult economically to go much above 105. Viscosity index is an empirical, unitless number which indicates the rate of change in the viscosity of an oil within a given temperature range. Fluids exhibiting a relatively large change in viscosity with temperature are said to have a low viscosity index. A low VI oil, for example, will thin out at elevated temperatures faster than a high VI oil. Usually, the high VI oil is more desirable because it has higher viscosity at higher temperature, which translates into better or thicker lubrication film and better protection of the contacting machine elements.

As used herein, the term "pour point" is the temperature at which a base stock no longer flows. For paraffinic base stocks, pour points can be between about −12° C. and about −15° C., as determined by operation of the dewaxing unit. For specialty purposes, pour points can be much lower. The pour points of naphthenic base stocks, which can have very low wax content, may be much lower (−30° C. to −50° C.). For very viscous base stocks such as Bright stocks, pour points can reflect a viscosity limit. Pour points are measured by ASTM D97.

As used herein, the term "sulfur" includes elemental sulfur and sulfur-containing compounds such as thiols, sulfides, thiophenes, benzo- and dibenzo-thiophenes, and more complex structures. The present hydrocarbon compositions are useful as engine oils and in other applications characterized by excellent stability, solvency and dispersancy characteristics. The hydrocarbon compositions are based on base stocks comprising components such Group I, II and/or III base stocks, gas-to-liquid (GTL), Group IV (e.g., PAO), Group V (e.g., esters, alkylated aromatics, PAG) and combinations thereof. The hydrocarbon compositions and/or base stocks can be any oil boiling in the lube oil boiling range, typically between about 100° C. to about 450° C.

As used herein, the term "hydrocarbon composition" is any composition containing hydrocarbon molecules.

Feedstock for Hydrocarbon Compositions

In various embodiments of the present invention, the hydrocarbon compositions are formed from one or more base stocks produced by conventional solvent processing and/or hydroprocessing of a feedstock.

Feedstock(s) (or feed(s)) can be characterized in various ways. One way to characterize feedstocks is based on the boiling range of the feed going into the conversion unit to produce a base stock. One option for characterizing feedstocks by boiling range is to specify an initial boiling point for a feed and/or a final boiling point for a feed. Another option, which in some instances may provide a more representative description of a feed, is to characterize a feed based on the amount of the feed that boils at one or more temperatures. For example, a boiling point for a feed is defined as the temperature at which 5 wt % of the feed will boil off. Similarly, a "T95" boiling point is a temperature at 95 wt % of the feed will boil.

Typical feeds include, for example, feeds with an initial boiling point of at least about 650 F. (343° C.), or at least about 700° F. (371° C.), or at least about 750° F. (399° C.). Alternatively, a feed may be characterized using a T5 boiling point, such as a feed with a T5 boiling point of at least about 650° F. (343° C.), or at least about 700° F. (371° C.), or at least about 750° F. (399° C.). Typical feeds include, for example, feeds with a final boiling point of about 1150° F. (621° C.), or about 1100° F. (593° C.) or less, or about 1050° F. (566° C.) or less.

Alternatively, a feed may be characterized using a T95 boiling point, such as a feed with a T95 boiling point of about 1150° F. (621° C.), or about 1100° F. (593° C.) or less, or about 1050° F. (566° C.) or less. It is noted that feeds with still lower initial boiling points and/or T5 boiling points may also be suitable, so long as sufficient higher boiling material is available so that the overall nature of the process is a lubricant base oil production process.

"Polyalphaolefin (PAO), Polyinternalolefin (PIO), and bio-derived base stocks are commonly used hydrocarbon oils. These base oils that may be used in the lubricating compositions may be derived from linear C2 to C32 alpha olefins, and mixtures thereof. By way of example, PAOs may derive preferably from C6, C8, C10, C12, C14, C16 alpha olefins, or mixtures thereof. See U.S. Pat. Nos. 4,956,122; 4,827,064; and 4,827,073, which are incorporated in their entirety herein. Particularly preferred feedstocks for said polyalphaolefins are 1-octene, 1-decene, 1-dodecene and 1-tetradecene."

Base stocks are distinguished by viscosity and are produced to certain viscosity specifications. Since viscosity is approximately related to molecular weight, the first step in manufacturing a base stock is to separate out lube precursor molecules of feedstock having the correct molecular weight range by distillation in a crude fractionation system. Lower-boiling fuel products of low viscosities and volatilities that have no application in lubricants are distilled off Therefore, higher molecular weight feedstocks (which do not vaporize at atmospheric pressure) can be fractionated by distillation at reduced pressure between about 10 mmHg to about 50 mmHg. The higher molecular weight feedstock is then fed to a vacuum tower where intermediate product streams such as light vacuum gas oil ("LVGO") and heavy vacuum gas oil ("HVGO") are produced. These intermediate product streams can be narrow cuts of specific viscosities destined for a solvent refining step, or they can be broader cuts destined for hydrocracking to lubes and fuels.

The feedstock can have a kinematic viscosity at 100° C. of about 1.5 cSt to about 20 cSt, or 1.5 cSt to 16 cSt, or 1.5 cSt to 12 cSt, or 1.5 cSt to 10 cSt, or 1.5 cSt to 8 cSt, or 1.5 cSt to 6 cSt, or 1.5 cSt to 5 cSt, or 1.5 cSt to 4 cSt, or 2.0 cSt to 20 cSt, or 2.0 cSt to 16 cSt, or 2.0 cSt to 12 cSt, or 2.0 cSt to 10 cSt, or 2.0 cSt to 8 cSt, or 2.0 cSt to 6 cSt, or 2.0 cSt to 5 cSt, or 2.0 cSt to 4 cSt, or 2.5 cSt to 20 cSt, or 2.5 cSt to 16 cSt, or 2.5 cSt to 12 cSt, or 2.5 cSt to 10 cSt, or 2.5 cSt to 8 cSt, or 2.5 cSt to 6 cSt, or 2.5 cSt to 5 cSt, or 2.5 cSt to 4 cSt, or 3.0 cSt to 20 cSt, or 3.0 cSt to 16 cSt, or 3.0 cSt to 12 cSt, or 3.0 cSt to 10 cSt, or 3.0 cSt to 8 cSt, or 3.0 cSt to 6 cSt, or 3.5 cSt to 20 cSt, or 3.5 cSt to 16 cSt, or 3.5 cSt to 12 cSt, or 3.5 cSt to 10 cSt, or 3.5 cSt to 8 cSt, or 3.5 cSt to 6 cSt.

Additionally or alternately, the feedstock can have a viscosity index of about 50 to about 120, or 60 to 120, or 70 to 120, or 80 to 120, or 90 to 120, or 100 to 120, or 50 to 110, or 60 to 110, or 70 to 110, or 80 to 110, or 90 to 110, or 50 to 100, or 60 to 100, or 70 to 100, or 80 to 100, or 50 to 90, or 60 to 90, or 70 to 90, or 50 to 80, or 60 to 80.

As an alternative to characterizing the feedstock based on viscosity index, a feedstock can be characterized based on the saturates content of the feed. In such aspects, a feedstock for forming a high viscosity base stock can have a saturates content of at least about 90 wt. %, or at least about 95 wt. %.

Additionally or alternately, the feedstock can have a density at 15.6° C. of about 0.91 g/cm$^3$ or less, or about 0.90 g/cm$^3$ or less, or about 0.89 g/cm$^3$ or less, or about 0.88 g/cm$^3$, or about 0.87 g/cm$^3$, such as down to about 0.84 g/cm$^3$ or lower.

Furthermore or alternately, the molecular weight of the feedstock can be characterized based on number average molecular weight (corresponding to the typical average weight calculation), and/or based on mass or weight average molecular weight, where the sum of the squares of the molecular weights is divided by the sum of the molecular weights, and/or based on polydispersity, which is the weight average molecular weight divided by the number average molecular weight.

The number average molecular weight Mn of a feed can be mathematically expressed as $$M_n = \frac{\sum_i N_i M_i}{\sum_i N_i} \tag{1}$$

In Equation (1), Ni is the number of molecules having a molecular weight Mi. The weight average molecular weight, Mw, gives a larger weighting to heavier molecules. The weight average molecular weight can be mathematically expressed as $$M_w = \frac{\sum_i N_i M_i^2}{\sum_i N_i M_i} \tag{2}$$

The polydispersity can then be expressed as Mw/Mn. In various aspects, the feedstock can have a polydispersity of 1.30 or less, or 1.25 or less, or 1.20 or less, and/or at least about 1.0. Additionally, or alternately, the feedstock can have a number average molecular weight (Mn) of 300 to 1000 g/mol. Additionally, or alternately, the feedstock can have a weight average molecular weight (Mw) of 500 to 1200 g/mol.

As described above, a wide range of petroleum and chemical feedstocks can be used for the present disclosure. Suitable hydrocarbon feedstocks include whole and reduced petroleum crudes, atmospheric, cycle oils, gas oils, including vacuum gas oils and coker gas oils, light to heavy distillates including raw virgin distillates, hydrocrackates, hydrotreated oils, petroleum-derived waxes (including slack waxes), Fischer-Tropsch waxes, raffinates, deasphalted oils and mixtures of these materials.

In some embodiments, hydrocarbon feedstocks are deasphalted oil (DAO), vacuum gas oil (VGO), vacuum distillates, intermediate streams, or combinations thereof. In some preferred embodiments, the hydrocarbon feedstreams are VGO/distillate straight from a 'fuels' based atmospheric/vacuum distillation tower. VGO/distillate from a 'lubes' based vacuum distillation tower, hydroprocessed VGO/distillate/DAO. In some embodiments, the hydrocarbon feedstreams are Group I or II base stocks.

One option for defining a boiling range of hydrocarbon feedstock is to use an initial boiling point for a hydrocarbon feedstream and/or a final boiling point for a hydrocarbon feedstream. Another option is to characterize a hydrocarbon feedstream based on the amount of the hydrocarbon feedstream that boils at one or more temperatures. For example, a "T5" boiling point/distillation point for a hydrocarbon feedstream is defined as the temperature at which 5 wt. % of the hydrocarbon feedstream will boil off. Similarly, a "T95" boiling point/distillation point is a temperature at which 95 wt. % of the hydrocarbon feedstream will boil. Boiling points, including fractional weight boiling points, can be determined using an appropriate ASTM test method, such as the procedures described in ASTM D2887, D2892, D6352, D7129 and/or D86.

Hydrocarbon feedstreams contemplated by the present invention in various embodiments include, for example, hydrocarbon feedstreams with an initial boiling point or a T5 boiling point or T10 boiling point of at least 600° F. (~316° C.), or at least 650° F. (~343° C.), or at least 700° F. (~371° C.), or at least 750° F. (~399° C.). Additionally or alternately, the final boiling point or T95 boiling point or T90 boiling point of the hydrocarbon feedstreams can be 1100° F. (~593° C.) or less, or 1050° F. (~566° C.) or less, or 1000° F. (~538° C.) or less, or 950° F. (~510° C.) or less. In particular, a hydrocarbon feedstream can have a T5 boiling point of at least 600° F. (~316° C.) and a T95 boiling point of 1100° F. (~593° C.) or less, or a T5 boiling point of at least 650° F. (~343° C.) and a T95 boiling point of 1050° F. (~566° C.) or less, or a T10 boiling point of at least 650° F. (~343° C.) and a T90 boiling point of 1050° F. (~566° C.) or less. Optionally, if the hydroprocessing is also used to form fuels, it can be possible to use a hydrocarbon feedstream that includes a lower boiling range portion. Such a hydrocarbon feedstream can have an initial boiling point or a T5 boiling point or T10 boiling point of at least 350° F. (~177° C.), or at least 400° F. (~204° C.), or at least 450° F. (~232° C.). In particular, such a hydrocarbon feedstream can have a T5 boiling point of at least 350° F. (~177° C.) and a T95 boiling point of 1100° F. (~593° C.) or less, or a T5 boiling point of at least 450° F. (~232° C.) and a T95 boiling point of 1050° F. (~566° C.) or less, or a T10 boiling point of at least 350° F. (~177° C.) and T90 boiling point of 1050° F. (~566° C.) or less.

In accordance with various embodiments of the invention, the aromatics content of the hydrocarbon feedstream can be at least 20 wt. %, or at least 25 wt. %, or at least 30 wt. %, or at least 40 wt. %, or at least 50 wt. %, or at least 60 wt. %, such as up to 75 wt. % or up to 90 wt. %. In particular, the aromatics content can be 25 wt. % to 75 wt. %, or 25 wt. % to 90 wt. %, or 35 wt. % to 75 wt. %, or 35 wt. % to 90 wt. %. In other aspects, the feed can have a lower aromatics content, such as an aromatics content of 35 wt. % or less, or 25 wt. % or less, such as down to 0 wt. %. In particular, the aromatics content can be 0 wt. % to 35 wt. %, or 0 wt. % to 25 wt. %, or 5.0 wt. % to 35 wt. %, or 5.0 wt. % to 25 wt. %. In a preferred embodiment, the hydrocarbon feedstream has an aromatics content of about 25 wt. % to about 75 wt. %.

In aspects where the hydroprocessing includes a hydrotreatment process and/or a sour hydrocracking process, the hydrocarbon feedstreams can have a sulfur content of 500 wppm to 20000 wppm or more, or 500 wppm to 10000 wppm, or 500 wppm to 5000 wppm. Additionally or alternately, the nitrogen content of such a hydrocarbon feedstream can be 20 wppm to 4000 wppm, or 50 wppm to 2000 wppm. In some aspects, the hydrocarbon feedstream can correspond to a "sweet" hydrocarbon feedstream, so that the sulfur content of the hydrocarbon feedstream is 10 wppm to 500 wppm and/or the nitrogen content is 1 wppm to 100 wppm.

In some embodiments, at least a portion of the hydrocarbon feedstream can correspond to a hydrocarbon feedstream derived from a biocomponent source. In this discussion, a bicomponent feedstock refers to a hydrocarbon feedstock derived from a biological raw material component, from bicomponent sources such as vegetable, animal, fish, and/or algae. Note that, for the purposes of this document, vegetable fats/oils refer generally to any plant-based material, and can include fat/oils derived from a source such as plants of the genus Jatropha. Generally, the biocomponent sources can include vegetable fats/oils, animal fats/oils, fish oils, pyrolysis oils, and algae lipids/oils, as well as components of such materials, and in some embodiments can specifically include one or more type of lipid compounds. Lipid compounds are typically biological compounds that are insoluble in water, but soluble in nonpolar (or fat) solvents. Non-limiting examples of such solvents include alcohols, ethers, chloroform, alkyl acetates, benzene, and combinations thereof.

In various embodiments of the present invention, the hydrocarbon compositions are produced by blending one or more base stocks with a high-sulfur containing material. High-sulfur containing materials may be any material that introduces a sufficient amount of sulfur to a hydrocarbon composition to achieve the desired amount of sulfur in the composition in accordance with various embodiments of the present invention. Examples of high-sulfur containing materials include, without limitation, vacuum gas oils (VGOs), raffinates, bright stocks, heavy neutral base stocks, process oils, extracts, used lubricants, and combinations thereof. Examples of extracts include, without limitation, lubricant extracts, extracts from hydroprocessing such as hydrofinishing, non-toxic distillate aromatic extracts, and combinations thereof.

Methods

In various embodiments of the present invention, the hydrocarbon compositions including base stocks, are catalytically processed. Catalytic processing can include one or more of hydrotreatment, hydrocracking, catalytic dewaxing, hydrofinishing and/or other catalytic processes. In aspects where more than one type of catalytic processing is performed, the effluent from a first type of catalytic processing can optionally be separated prior to the second type of catalytic processing. For example, after a hydrotreatment or hydrofinishing process, a gas-liquid separation can be performed to remove light ends, $H_2S$, and/or $NH_3$ that can have formed. The use of non-catalytic processes alone or in combination with catalytic processes are also contemplated by the present invention. Examples of non-catalytic processes, without limitation, may include processing using solvents such as solvent extraction, mechanical processes such as membrane separation and/or coking processes.

Hydrotreatment typically reduces sulfur, nitrogen, and aromatic content of the feedstock. Catalysts used in hydrotreatment of the heavy portion of a crude oil can include conventional hydroprocessing catalysts, such as those that comprise at least one Group VIII non-noble metal (Columns 8-10 of IUPAC periodic table), such as Fe, Co, and/or Ni, such as Co and/or Ni; and at least one Group VI metal (Column 6 of IUPAC periodic table), such as Mo and/or W. Such hydroprocessing catalysts optionally include transition metal sulfides that are impregnated or dispersed on a refractory support or carrier such as alumina and/or silica. The support or carrier itself typically has no significant/measurable catalytic activity. Substantially carrier- or support-free catalysts, commonly referred to as bulk catalysts, generally have higher volumetric activities than their supported counterparts.

The catalysts can either be in bulk form or in supported form. In addition to alumina and/or silica, other suitable support/carrier materials can include, but are not limited to, zeolites, titania, silica-titania, and titania-alumina. Suitable aluminas are porous aluminas such as gamma or eta having average pore sizes from about 50 to about 200 Å, or about 75 to about 150 Å, a surface area from about 100 to about 300 $m^2/g$, or about 150 to about 250 $m^2/g$, and a pore volume of from about 0.25 to about 1.0 $cm^3/g$, or about 0.35 to about 0.8 $cm^3/g$. More generally, any convenient size, shape, and/or pore size distribution for a catalyst suitable for hydrotreatment of a distillate (including lubricant hydrocarbon composition) boiling range feed in a conventional manner can be used. It is within the scope of the present disclosure that more than one type of hydroprocessing catalyst can be used in one or multiple reaction vessels.

The at least one Group VIII non-noble metal, in oxide form, can typically be present in an amount ranging from about 2 wt. % to about 40 wt. %, and from about 4 wt. % to about 15 wt. %. The at least one Group VI metal, in oxide form, can typically be present in an amount ranging from about 2 wt. % to about 70 wt. %, for supported catalysts from about 6 wt. % to about 40 wt. % or from about 10 wt. % to about 30 wt. %. The weight percent is based on the total weight of the catalyst. Suitable metal catalysts include cobalt/molybdenum (1-10% Co as oxide, 10-40% Mo as oxide), nickel/molybdenum (1-10% Ni as oxide, 10-40% Co as oxide), or nickel/tungsten (1-10% Ni as oxide, 10-40% tungsten as oxide) on alumina, silica, silica-alumina, or titania.

In accordance with various embodiments of the invention, the hydrotreatment can be carried out in the presence of hydrogen. A hydrogen stream is, therefore, fed or injected into a vessel or reaction zone or hydroprocessing zone in which the hydroprocessing catalyst is located. Hydrogen, which is contained in a hydrogen "treat gas," is provided to the reaction zone. Treat gas, as referred to in this disclosure, can be either pure hydrogen or a hydrogen-containing gas, which is a gas stream containing hydrogen in an amount that is sufficient for the intended reaction(s), optionally including one or more other gasses (e.g., nitrogen and light hydrocarbons such as methane), and which will not adversely interfere with or affect either the reactions or the products. Impurities, such as $H_2S$ and $NH_3$ are undesirable and would typically be removed from the treat gas before it is conducted to the reactor. The treat gas stream introduced into a reaction stage can contain at least about 50 vol. % and at least about 75 vol. % hydrogen.

Hydrotreating conditions can include temperatures of 200° C. to 450° C., or 315° C. to 425° C.; pressures of 250 psig (1.8 MPag) to 5000 psig (34.6 MPag) or 300 psig (2.1 MPag) to 3000 psig (20.8 MPag); liquid hourly space velocities (LHSV) of 0.1 $hr^{-1}$ to 10 $hr^{-1}$; and hydrogen treat rates of 200 scf/B (35.6 $m^3/m^3$) to 10,000 scf/B (1781 $m^3/m^3$), or 500 (89 $m^3/m^3$) to 10,000 scf/B (1781 $m^3/m^3$).

Additionally, or alternately, a potential high viscosity base stock can be exposed to catalytic dewaxing conditions. Catalytic dewaxing can be used to improve the cold flow properties of the base stock and/or the hydrocarbon composition, and potentially perform some heteroatom removal and aromatic saturation. Suitable dewaxing catalysts can include molecular sieves such as crystalline aluminosilicates (zeolites). In an aspect, the molecular sieve can comprise, consist essentially of, or be ZSM-5, ZSM-22, ZSM-23, ZSM-35, ZSM-48, zeolite Beta, or a combination thereof, for example ZSM-23 and/or ZSM-48, or ZSM-48 and/or zeolite Beta. Optionally, molecular sieves that are selective for dewaxing by isomerization as opposed to cracking can be used, such as ZSM-48, zeolite Beta, ZSM-23, or a combination thereof. Additionally, or alternately, the molecular sieve can comprise, consist essentially of, or be a 10-member ring 1-D molecular sieve. Examples include EU-1, ZSM-35 (or ferrierite), ZSM-11, ZSM-57, NU-87, SAPO-11, ZSM-48, ZSM-23, and ZSM-22. Preferred materials are EU-2, EU-11, ZBM-30, ZSM-48, or ZSM-23. Note that the zeolite having the ZSM-23 structure with a silica to alumina ratio of from about 20:1 to about 40:1 can sometimes be referred to as SSZ-32. Other molecular sieves that are isostructural with the above materials include Theta-1, NU-10, EU-13, KZ-1, and NU-23. Optionally, the dewaxing catalyst include a binder for the molecular sieve, such as alumina, titania, silica, silica-alumina, zirconia, or a combination thereof, for example alumina and/or titania or silica and/or zirconia and/or titania.

The dewaxing catalysts used in processes include catalysts with a low ratio of silica to alumina. For example, for ZSM-48, the ratio of silica to alumina in the zeolite can be less than about 200:1, such as less than about 110:1, or less than about 100:1, or less than about 90:1, or less than about 75:1. In various aspects, the ratio of silica to alumina can be from 50:1 to 200:1, such as 60:1 to 160:1, or 70:1 to 100:1.

In any aspect, the catalysts according to the disclosure further include a metal hydrogenation component. The metal hydrogenation component is typically a Group VI and/or a Group VIII metal. In an aspect, the metal hydrogenation component can be Pt, Pd, or a mixture thereof. In an alternative, the metal hydrogenation component can be a combination of a non-noble Group VIII metal with a Group VI metal. Suitable combinations can include Ni, Co, or Fe with Mo or W.

The metal hydrogenation component can be added to the catalyst in any convenient manner. One technique for adding the metal hydrogenation component is by incipient wetness. For example, after combining a zeolite and a binder, the combined zeolite and binder can be extruded into catalyst particles. These catalyst particles can then be exposed to a solution containing a suitable metal precursor. Alternatively, metal can be added to the catalyst by ion exchange, where a metal precursor is added to a mixture of zeolite (or zeolite and binder) prior to extrusion.

The amount of metal in the catalyst can be at least 0.1 wt. % based on catalyst, or at least about 0.15 wt. %, or at least about 0.2 wt. %, or at least about 0.25 wt. %, or at least about 0.3 wt. %, or at least about 0.5 wt. % based on catalyst. The amount of metal in the catalyst can be about 20 wt. % or less based on catalyst, or about 10 wt. % or less, or about 5 wt. % or less, or about 2.5 wt. % or less, or about 1 wt. % or less. Where the metal is Pt, Pd, another Group VIII noble metal, or a combination thereof, the amount of metal can be from about 0.1 to about 5 wt. %, from about 0.1 to about 2 wt. %, or about 0.25 to about 1.8 wt. %, or about 0.4 to about 1.5 wt. %. For aspects where the metal is a combination of a non-noble Group VIII metal with a Group VI metal, the combined amount of metal can be from 0.5 wt. % to 20 wt. %, or 1 wt. % to 15 wt. %, or 2.5 wt. % to 10 wt. %.

The dewaxing catalysts can also include a binder. In some embodiments, the dewaxing catalysts can be formulated using a low surface area binder, where a low surface area binder represents a binder with a surface area of 100 $m^2/g$ or less, or 80 $m^2/g$ or less, or 70 $m^2/g$ or less. The amount of zeolite in a catalyst formulated using a binder can be from about 30 wt. % zeolite to 90 wt. % zeolite relative to the combined weight of binder and zeolite. The amount of zeolite is at least about 50 wt. % of the combined weight of zeolite and binder, such as at least about 60 wt. % or from about 65 wt. % to about 80 wt. %.

In accordance with various embodiments of the invention, a zeolite can be combined with binder in any convenient manner. For example, a bound catalyst can be produced by starting with powders of both the zeolite and binder, combining and mulling the powders with added water to form a mixture, and then extruding the mixture to produce a bound catalyst of a desired size. Extrusion aids can also be used to modify the extrusion flow properties of the zeolite and binder mixture. The amount of framework alumina in the catalyst can range from 0.1 to 3.33 wt. %, or 0.1 to 2.7 wt. %, or 0.2 to 2 wt. %, or 0.3 to 1 wt. %.

Process conditions in a catalytic dewaxing zone in a sour environment can include a temperature of from about 200° C. to about 450° C., and about 270° C. to about 400° C., a hydrogen partial pressure of from 1.8 MPag to 34.6 MPag (250 psig to 5000 psig), and 4.8 MPag to 20.8 MPag, and a hydrogen circulation rate of from 35.6 $m^3/m^3$ (200 scf/B) to 1781 $m^3/m^3$ (10,000 scf/B), and 178 $m^3/m^3$ (1000 scf/B) to 890.6 $m^3/m^3$ (5000 scf/B). Other conditions can include temperatures in the range of about 600° F. (343° C.) to about 815° F. (435° C.), hydrogen partial pressures of from about 500 psig to about 3000 psig (3.5 MPag-20.9 MPag), and hydrogen treat gas rates of from about 213 $m^3/m^3$ to about 1068 $m^3/m^3$ (1200 scf/B to 6000 scf/B). These latter conditions can be suitable, for example, if the dewaxing stage is operating under sour conditions. The LHSV can be from about 0.2 $h^{-1}$ to about 10 $h^{-1}$, such as from about 0.5 $h^{-1}$ to about 5 $h^{-1}$ and/or from about 1 $h^{-1}$ to about 4 $h^{-1}$.

Additionally, or alternately, the base stock can be exposed to hydrofinishing or aromatic saturation conditions to provide a high viscosity base stock. Hydrofinishing and/or aromatic saturation catalysts can include catalysts containing Group VI metals, Group VIII metals, and mixtures thereof. In an aspect, the metals include at least one metal sulfide having a strong hydrogenation function. In an aspect, the hydrofinishing catalyst can include a Group VIII noble metal, such as Pt, Pd, or a combination thereof. The mixture of metals can also be present as bulk metal catalysts wherein the amount of metal is about 30 wt. % or greater based on catalyst. Suitable metal oxide supports include low acidic oxides such as silica, alumina, silica-aluminas or titania. The hydrofinishing catalysts for aromatic saturation will comprise at least one metal having relatively strong hydrogenation function on a porous support. Typical support materials include amorphous or crystalline oxide materials such as alumina, silica, and silica-alumina. The support materials can also be modified, such as by halogenation, or in particular, fluorination. The metal content of the catalyst is often as high as about 20 wt. % for non-noble metals. In an aspect, the hydrofinishing catalyst can include a crystalline material belonging to the M41S class or family of catalysts. The M41S family of catalysts are mesoporous materials having high silica content. Examples include MCM-41, MCM-48 and MCM-50. If separate catalysts are used for aromatic saturation and hydrofinishing, an aromatic saturation catalyst can be selected based on activity and/or selectivity for aromatic saturation, while a hydrofinishing catalyst can be selected based on activity for improving product specifications, such as product color and polynuclear aromatic reduction.

Hydrofinishing conditions can include temperatures from about 125° C. to about 425° C., and about 180° C. to about 280° C., a hydrogen partial pressure from about 500 psig (3.4 MPa) to about 3000 psig (20.7 MPa), and about 1500 psig (10.3 MPa) to about 2500 psig (17.2 MPa), and liquid hourly space velocity from about 0.1 $hr^{-1}$ to about 5 $hr^{-1}$ LHSV, and about 0.5 $hr^{-1}$ to about 1.5 $hr^{-1}$. Additionally, a hydrogen gas rate of from 35.6 $m^3/m^3$ to 1781 $m^3/m^3$ (200 scf/B to 10,000 scf/B) can be used.

Alternatively, PAO, PIO, and bio-derived fluids are conveniently made by the oligomerization or dimerization of an alphaolefin in the presence of a polymerization catalyst such as the Friedel-Crafts catalysts including, for example, aluminum trichloride, boron trifluoride or complexes of boron trifluoride with water, alcohols such as ethanol, propanol or butanol, carboxylic acids or esters such as ethyl acetate or ethyl propionate. For example the methods disclosed by U.S. Pat. No. 4,149,178 or 3,382,291 are contemplated herein. Other descriptions of PAO synthesis are found in the following U.S. Pat. Nos. 3,742,082; 3,769,363; 3,876,720; 4,239,930; 4,367,352; 4,413,156; 4,434,408; 4,910,355; 4,956,122; and 5,068,487. The dimers of the C14 to C18 olefins are described in U.S. Pat. No. 4,218,330. All of the foregoing are incorporated in their entirety herein.

Compositions

The hydrocarbon compositions of the present invention are suitable for using as base stocks, base oils, lubricants, process oils, fluids, and the like and/or components of any of the foregoing. According to various embodiments of the invention, the composition is a base stock, a base stock blend, a lubricant, a process oil, a fluid (for example, an electric vehicle fluid) or a blend of any of the foregoing. Base stocks are materials, typically a fluid at the operating temperature of the lubricant, used to formulate a lubricant by admixing with other components. As described herein, non-limiting examples of base stocks suitable in lubricants include API Group I, Group II, Group III, Group IV, and Group V base stocks.

Base stocks are generally classified into two broad types—naphthenic and paraffinic—depending on the crude types they are derived from. Naphthenic crudes are characterized by the absence of wax or have very low levels of wax. Therefore, naphthenic crudes are largely cycloparaffinic and aromatic in composition. Further, naphthenic lube fractions without any dewaxing are generally liquid at low temperatures. Paraffinic crudes contain wax, and are largely composed of n- and iso-paraffins which have high melting points.

In accordance with various embodiments of the invention, the base stock can be a natural oil or a combination of natural oils. Natural oils (or mixtures thereof) can be used unrefined, refined, or re-refined (the latter is also known as reclaimed or reprocessed oil). Unrefined oils are those obtained directly from a natural source and used without added purification. These include shale oil obtained directly from retorting operations, petroleum oil obtained directly from primary distillation, and ester oil obtained directly from an esterification process. Refined oils are similar to unrefined oils except refined oils are subjected to one or more purification steps to improve the at least one lubricating oil property.

To produce the base stock, the process steps can include solvent extraction, secondary distillation, acid extraction, base extraction, filtration, percolation, oligomerization and dimerizations of olefins including poly alpha olefins, poly internal olefins and bio-derived base stocks. Re-refined oils are obtained by processes analogous to refined oils but using an oil that has been previously used as a feedstock. Natural oils vary as to the method used for their production and purification, for example, their distillation range and whether they are straight run or cracked, hydrorefined, or solvent extracted. Feedstock can also include used oils, pretreated oils and other recycled materials.

Also, natural oils can include animal oils, vegetable oils (castor oil and lard oil, for example), and mineral oils. Animal and vegetable oils possessing favorable thermal oxidative stability can be used. Of the natural oils, mineral oils are preferred. Mineral oils vary widely as to their crude source, for example, as to whether they are paraffinic, naphthenic, or mixed paraffinic-naphthenic.

Groups I, II, III, IV and V are broad categories of base stocks. See e.g., API Publication 1509. Group I base stocks generally have a viscosity index of from 80 to 120 and contain greater than 0.03% sulfur and less than 90% saturates. Group II base stocks generally have a viscosity index of from 80 to 120 and contain less than or equal to 0.03% sulfur and greater than or equal to 90% saturates. Group III base stocks generally have a viscosity index greater than 120 and contains less than or equal to 0.03% sulfur and greater than 90% saturates. Group IV base stocks include polyalpha-olefins. Group V base stocks include base stocks not included in Groups I-IV. Table 1 below summarizes properties of each of these five groups.

TABLE 1

| Base Stock Properties | | | |
|---|---|---|---|
| | Saturates | Sulfur | Viscosity Index |
| Group I | <90 and/or | >0.03% and | ≥80 and <120 |
| Group II | ≥90 and | ≤0.03% and | ≥80 and <120 |
| Group III | ≥90 and | ≤0.03% and | ≥120 |
| Group IV | Includes PAO products | | |
| Group V | All other base stocks not included in Groups I, II, III, or IV | | |

Group II and/or Group III base stocks are hydroprocessed and/or hydrocracked base stocks. According to various embodiments, the composition of the present invention is a Group II or a Group III base stock. According to various embodiments of the invention, the composition of the invention is a blend of base stocks, including for example, without limitation, multiple Group II and/or Group III base stocks. According to various embodiments of the present invention, the compositions of the invention include a Group II and/or Group III base stock in combination with a synthetic oil. Synthetic oils include hydrocarbon oil such as polymerized and interpolymerized olefins such as polybutylenes, polypropylenes, propylene isobutylene copolymers, ethylene-olefin copolymers, and ethylene-alpha-olefin copolymers, for example. Polyalpha-olefin oil base stocks, the Group IV API base stocks, can be used as base stock. By way of example, PAOs derived from $C_8$, $C_{10}$, $C_{12}$, $C_{14}$ olefins or mixtures thereof can be utilized. See U.S. Pat. Nos. 4,956,122; 4,827,064; and 4,827,073. Group IV hydrocarbon compositions and base stocks have viscosity indices greater than about 130, greater than about 135, and greater than about 140.

According to various embodiments of the invention, the hydrocarbon compositions comprise about 27.8 wt. % to about 99.7 wt. % of paraffins and about 0 to about 63.9 wt. % of naphthenes. According to various embodiments of the invention, the hydrocarbon compositions comprise about 30 wt. % to about 95 wt. %, about 35 wt. % to about 90 wt. %, or about 40 wt. % to about 85 wt. % of paraffins. According to various embodiments of the invention, the naphthenes comprise about 5 wt. % to about 70 wt. %, to about 10 wt. % to 65 wt. %, or 15 to 60 wt. % of naphthenes.

As described herein, the present hydrocarbon compositions comprise one or more base stocks. In various embodiments of the invention, a base stock has a kinematic viscosity at 100° C. ("KV100"), measured according to ASTM standard D-445, from about 3 cSt to about 12 cSt, about 3.5 cSt to about 7.0 cSt, or about 4.0 cSt to about 5.0 cSt. In various embodiments of the invention, the base stocks have a kinematic viscosity at 40° C. ("KV40"), measured according to ASTM standard D-445, from about 15 cSt to about 120 cSt, from about 18 cSt to about 45 cSt, or from about 20 cSt to about 30 cSt. The base stock or base stock blend may have a viscosity index, calculated according to ASTM standard D-2270, from about 80 to about 150, from 95 to about 140, from about 105 to about 130, from about 105 to about 119, or from about 120 to about 130.

Base stocks can have a NOACK volatility of no greater than about 35%, preferably no greater than about 30%, and more preferably no greater than about 25%. According to various embodiments of the invention, the base stocks have a Noack volatility of between about 5.0 wt. % to about 15.0 wt. % or about 7.0 wt. % to about 15.0 wt. %. As used herein, Noack volatility is determined by ASTM D-5800.

Additionally, or alternatively, the base stocks have a pour point of less than about −20° C., less than about −40° C., less than about −50° C., less than about −60° C. according to various embodiments of the present invention. According to various embodiments of the invention, the base stocks have a pour point of between about −15° C. and −60° C.

The present hydrocarbon compositions comprise between about 30 ppm to about 220 ppm sulfur. According to various embodiments of the invention, the compositions comprise 50 to 200 ppm sulfur or about 100 to 175 ppm sulfur. The present hydrocarbon compositions comprise between about 0.2 wt. % to about 3 wt. % aromatics. According to various embodiments of the invention, the compositions comprise 0.5 wt. % to 3 wt. % aromatics or 1 wt. % to 3 wt. % aromatics.

The hydrocarbon composition comprising a combination of a base stock or blend of base stocks and at least one high-sulfur containing material. According to various embodiments of the invention, the high-sulfur containing material comprises between about 0.01 to 4.5 wt. % sulfur. According to various embodiments of the invention, the high-sulfur containing material further comprises between about 3 wt. % to 75 wt. % of aromatics. According to various embodiments of the invention the high-sulfur containing material comprises between about 0.01 to 4.5 wt. % sulfur and between about 3 wt. % to 75 wt. % of aromatics.

In various embodiments of the present invention, the hydrocarbon compositions comprise a blend of one or more base stocks and a high-sulfur containing material, wherein one or more of the base stocks has a kinematic viscosity at 100° C. between about 3.0 cSt and about 12.0 cSt, a viscosity index (VI) between about 80 and about 150, a pour point between about −15° C. and −60° C., a NOACK volatility between about 5.0 wt. % and 15.0 wt. %, a sulfur content between about 0 ppm and 100 ppm, aromatics in an amount less than 3.0 wt. %, and an NMR branching index between about 20.6 and 38.3, and the high-sulfur containing material comprises between about 0.01 to 4.5 wt. % sulfur. In a further aspect, the one or more base stock comprises Group II base stock and/or Group III base stock. In a further aspect, the base stock comprises polyalpha-olefins. In a further aspect, the aromatics comprise 3+ ring aromatics or 4+ ring aromatics. In a further aspect, the base stocks are further blended with at least one additive. In a further aspect, the high-sulfur containing material can be a refining extract, used oil (pretreated or un-pretreated), or other petroleum stream.

In an aspect of the invention, a lubricant formulated with the hydrocarbon composition has a weighted piston deposit result between about 4.17 to about 4.85 merits as measured by ASTM D8111 (the Sequence IIIH Test). In an aspect of the invention, the lubricant has a viscosity increase at 100° C. between about 0.10% and 29% and as measured by the ASTM D8111 (Sequence IIIH Test). In an aspect of the invention, the lubricant has an improvement in weighted piston deposit between about 0.2 to about 0.6 merits by ASTM D8111 (the Sequence IIIH Test). In another aspect of the invention, the lubricant has an increased viscosity at 100° C. of about 70% to about 100% on by ASTM D8111 (Sequence IIIH Test).

In further aspects of the invention, compositions comprise between about 80 wt. % to about 98 wt. % base stock (or blend of base stocks) and about 2 wt. % to about 20 wt. % additives.

Additives

In accordance with various embodiments of the invention, the present hydrocarbon compositions can be combined with one or more lubricating oil performance additives (also referred to herein as "additives") including but not limited to anti-wear additives, detergents, dispersants, viscosity modifiers, corrosion inhibitors, rust inhibitors, metal deactivators, extreme pressure additives, anti-seizure agents, wax modifiers, other viscosity modifiers, fluid-loss additives, seal compatibility agents, lubricity agents, anti-staining agents, chromophoric agents, defoamants, demulsifiers, emulsifiers, densifiers, wetting agents, gelling agents, tackiness agents, colorants, and others. For a review of useful additives, see "Lubricant Additives, Chemistry and Applications", Ed. L. R. Rudnick, Marcel Dekker, Inc. 270 Madison Ave., New York, N.J. 10016, 2003, and Klamann in Lubricants and Related Products, Verlag Chemie, Deerfield Beach, Fla.; ISBN 0-89573-177-0. Reference is also made to "Lubricant Additives" by M. W. Ranney, published by Noyes Data Corporation of Parkridge, NJ (1973); see also U.S. Pat. No. 7,704,930, the disclosure of which is incorporated herein in its entirety. Additives can be delivered with varying amounts of diluent oil that may range from 5 wt. % to 50 wt. %. Additives do not have to be soluble in the lubricating oils. Insoluble additives such as zinc stearate in oil can be dispersed in the lubricating oils of this disclosure. In various embodiments, some or all of the additives are provided in a premixed additive package. In various embodiments, the additive comprises an ILSAC GF-6 additive or an ILSAC GF-6 additive package.

When the present hydrocarbon compositions comprise one or more additives, the additive(s) are blended into the hydrocarbon composition in an amount sufficient for it to perform its intended function. Additives will be a minor component of the hydrocarbon composition, typically in an amount of less than 50 wt. %, less than about 30 wt. %, and less than about 15 wt. %, based on the total weight of hydrocarbon composition. Additives can be added to the hydrocarbon composition in an amount of at least 0.1 wt. %, at least 1 wt. %, and at least 5 wt. %. Typical amounts of such additives are shown in Table 2 below, for example.

It is noted that many of the additives are shipped from the additive manufacturer as a concentrate, containing one or more additives together, with a certain amount of hydrocarbon composition diluents. Accordingly, the weight amounts in the Table 2 below, as well as other amounts mentioned herein, are directed to the amount of active ingredient (that is the non-diluent portion of the ingredient). The weight percent indicated below is based on the total weight of the lubricating oil composition.

TABLE 2

Typical Amounts of Other Lubricating Oil Components

| Compound | Approximate wt. % (Useful) | Approximate wt. % (Preferred) |
|---|---|---|
| Dispersant | 0.1-20 | 0.1-8 |
| Detergent | 0.1-20 | 0.1-8 |
| Friction Modifier | 0.01-5 | 0.01-1.5 |
| Antioxidant | 0.1-5 | 0.1-1.5 |
| Pour Point Depressant (PPD) | 0.0-5 | 0.01-1.5 |
| Anti-foam Agent | 0.001-3 | 0.001-0.15 |
| Viscosity Modifier (solid polymer basis) | 01.-2 | 0.1-1 |
| Anti-wear | 02.-3 | 0.5-1 |
| Inhibitor and Antirust | 0.01-5 | 0.01-1.5 |

The foregoing additives are all commercially available materials. These additives may be added independently but are usually combined in packages which can be obtained from suppliers of lubricant oil additives. Additive packages with a variety of ingredients, proportions and characteristics are available and selection of the appropriate package will take the requisite use of the ultimate composition into account.

The present hydrocarbon compositions perform well as lube base stocks without blending limitations. Further, the present hydrocarbon compositions are also compatible with lubricant additives as lubricant formulations. As described herein, base stocks can optionally be blended with other base stocks to form the present hydrocarbon compositions. Useful base stocks include Group I, III, IV and V base stocks and gas-to-liquid oils. One or more of the base stocks can be blended into the hydrocarbon composition from 0.1 to 50 wt. %, or 0.5 to 40 wt. %, 1 to 35 wt. %, or 2 to 30 wt. %, or 5 to 25 wt. %, or 10 to 20 wt. %, based on the total hydrocarbon composition.

As shown in the example, the present hydrocarbon compositions can have improved oxidative stability over analogous lubricant compositions including prior art Group II base stocks. The present hydrocarbon compositions can be employed in a variety of lubricant-related end uses, such as a lubricant oil or grease for a device or apparatus requiring lubrication of moving and/or interacting mechanical parts, components, or surfaces. Useful applications include engines and machines. The present hydrocarbon compositions are most suitable for use in the formulation of automotive crank case lubricants, automotive gear oils, transmission oils, many industrial lubricants including circulation lubricant, industrial gear lubricants, grease, compressor oil, pump oils, refrigeration lubricants, hydraulic lubricants, metal working fluids. Furthermore, the present hydrocarbon compositions can be derived from renewable sources; it is considered a sustainable product and can meet "sustainability" standards set by different industry groups or government regulations.

The following non-limiting examples are provided to illustrate the disclosure.

Example I

Lubricant formulations can deliver robust oxidation performance through the selection of hydrocarbon compositions. Provided herein are hydrocarbon compositions that can deliver improvements in oxidative stability through the use of sulfur and aromatic components such as those found in refining extracts and re-refined base stocks. The data below was generated on the Sequence IIIH Engine Test (ASTM D8111). The hydrocarbon compositions were each blended with a GF-6 additive package.

High levels of sulfur and aromatics are typically harmful to oxidative stability. As shown in Table 3, an increase in sulfur and aromatics of the base stock can negatively impact oxidation performance as observed through an increase in viscosity and a decrease in piston deposit merits.

TABLE 3

Results

| | Base Stock A/ Base Stock B/ Base Stock D Baseline 1 | Base Stock A/ Base Stock C/ Base Stock D Sample 1 | Base Stock A/ Base Stock B/ Base Stock D Sample 2 |
|---|---|---|---|
| Base Oil Sulfur (PPM) | <5 | 7 | 172 |
| Base Oil Aromatics (wt. %) | <0.2 | 0.6 | 0.5 |
| Viscosity Increase - EOT (%) | 67% | 72% | 18% |
| Weighted Piston Deposits - merits | 4.08 | 3.79 | 4.28 |

The unexpected improvement comes from deploying the sulfur and aromatic species through use of the high-sulfur containing material, Base Stock A/Base Stock B/Base Stock C with high-sulfur containing material (Sample 2 above). In comparing the Baseline 1 to Sample 2, a significant improvement is observed in both viscosity control and weighted piston deposit merits which is indicative of improved oxidation stability.

TABLE 4

Formulation Summary

| | Base Stock A/ Base Stock B/ Base Stock D Baseline 1 | Base Stock A/ Base Stock C/ Base Stock D Sample 1 | Base Stock A/ Base Stock B/ Base Stock D Sample 2 |
|---|---|---|---|
| Base Stock A | 35.9 | 39.14 | 45 |
| Base Stock B | 8.1 | | 3.75 |
| Base Stock C | | 4.91 | |
| High-Sulfur Containing Material | | | 0.3 |
| Base Stock D | 40 | 40 | 35 |
| GF-6 Additive Package | 15.95 | 15.95 | 15.95 |
| Total | 100 | 100 | 100 |

As provided in Tables 5 and 6 below, a PAO base stock (Baseline 2) was compared to the present hydrocarbon composition (Example 3) comprising a blend of two PAO base stocks and the high-sulfur containing material. Viscosity increases as well as improvement in weighted piston deposit were observed when aromatics and sulfur were added to the base stock blend.

TABLE 5

PAO Results

| | PAO 4/PAO 6 Baseline 2 | PAO 4/PAO 6/ HC Example 3 |
|---|---|---|
| Base Oil Sulfur (PPM) | <5 | 174 |
| Base Oil Aromatics (wt. %) | <0.2 | 0.2 |
| Viscosity Increase at EOT (%) | 1.6 | −4.0* |
| Weighted Piston Deposits (merits) | 4.49 | 4.85 |

TABLE 6

PAO Formulations

| | PAO 4/PAO 6 Baseline 2 | PAO 4/PAO 6/ HC Example 3 |
|---|---|---|
| PAO 4 | 57.05 | 60 |
| PAO 6 | 27 | 23.75 |
| High-Sulfur Containing Material | | 0.3 |
| GF-6 Additive Package | 15.95 | 15.95 |
| | 100 | 100 |

Another method for increasing the sulfur and aromatic content in the hydrocarbon composition is to use base stocks with residual sulfur from processing. We evaluated the use of these base stocks to improve oxidation performance. For this comparison, we compared the Base Stock A, Base Stock B and Base Stock D (Baseline 1) to Base Stock E and Base Stock F with residual sulfur from processing (Sample 4 and 5). As shown in Table 7, once again, an increased sulfur and aromatic content in both of these examples have a positive impact to oxidation through an increase in weighted piston deposits and a decrease is viscosity increase.

TABLE 7

Residual Sulfur from Processing

| | Base Stock A/ Base Stock B/ Base Stock D Baseline 1 | Base Stock D/ Base Stock E Sample 4 | Base Stock F Sample 5 |
|---|---|---|---|
| Base Oil Sulfur (PPM) | <5 | 84.4 | 59.4 |
| Base Oil Aromatics (wt. %) | <0.2 | 2.2 | 2.1 |
| Viscosity Increase at EOT (%) | 67.2 | 29.0 | 8.1 |
| Weighted Piston Deposits (merits) | 4.08 | 4.17 | 4.65 |

Table 8 below shows a summary of the formulations referenced above in Table 7.

TABLE 8

Residual Sulfur from Processing Formulation Summary

| | Base Stock A/ Base Stock B/ Base Stock D Baseline 1 | Base Stock D/ Base Stock E Sample 1 | Base Stock F Sample 2 |
|---|---|---|---|
| Base Stock A | 35.9 | | |
| Base Stock B | 8.1 | | |
| Base Stock D | 40 | 13.06 | |
| Base Stock E (High Sulfur) | | 70.99 | |

TABLE 8-continued

Residual Sulfur from Processing Formulation Summary

| | Base Stock A/ Base Stock B/ Base Stock D Baseline 1 | Base Stock D/ Base Stock E Sample 1 | Base Stock F Sample 2 |
|---|---|---|---|
| Base Stock F (High Sulfur) | | | 84.05 |
| GF-6 Additive Package | 15.95 | 15.95 | 15.95 |
| Total | 100 | 100 | 100 |

Example II

In accordance with various embodiments of the invention, improvements in oxidative stability may be achieved when hydrocarbon compositions are prepared using a Group I base stock as the high-sulfur containing material. As shown below in Table 9, hydrocarbon compositions are prepared by blending a Group II base stock with one or more Group I base stocks. Like the Example above, hydrocarbon compositions would be prepared by blending with a GF-6 additive package.

TABLE 9

Projected Results

| | Group II Reference | Group I LN Blend - Predict | Group I HN Blend - Predict | Group I BS Blend - Predict |
|---|---|---|---|---|
| Group II | 84.05 | 79.05 | 81.8 | 82.4 |
| Group I LN | | 5 | | |
| Group I HN | | | 2.25 | |
| Group I BS | | | | 1.65 |
| GF-6 Additive Package | 15.95 | 15.95 | 15.95 | 15.95 |
| Total | 100 | 100 | 100 | 100 |
| Base Oil Sulfur (ppm) | 7 | 221 | 221 | 223 |
| Base Oil Aromatics (wt. %) | 0.2 | 1.3 | 1 | 1.1 |
| Viscosity Increase - EOT (%) Predicted | 36.44 | 4.63 | 3.68 | 3.52 |
| Weighted Piston Deposits - merits Predicted | 4.14 | 4.05 | 4.17 | 4.23 |

The hydrocarbon compositions are projected to have higher sulfur and aromatics contents compared to the Group II base stock. Like the hydrocarbon compositions in the Example I above, viscosity increases will diminish and piston deposit merits will increase. These improvements in viscosity control and weighted piston deposit merits will indicate an improved oxidation stability.

When numerical lower limits and numerical upper limits are listed herein, ranges from any lower limit to any upper limit are contemplated. Although the present disclosure has been described in terms of specific aspects, it is not so limited. Suitable alterations/modifications for operation under specific conditions should be apparent to those skilled in the art. It is therefore intended that the following claims be interpreted as covering all such alterations/modifications as fall within the true spirit/scope of the disclosure.

Additional Embodiments

Embodiment 1. A hydrocarbon composition comprising: about 30 ppm to about 220 ppm of sulfur; about 0.2 wt. % to about 3 wt. % of aromatics; about 27.8 wt. % to about 99.7 wt % of paraffins; about 0.0 wt. % to 63.9 wt. % of naphthenes; wherein the hydrocarbon composition demonstrates an increase in lubricant weighted piston deposit merits over a hydrocarbon composition having the same amount of paraffins and naphthenes and less than 30 ppm of sulfur and less than 0.2 wt. % aromatics.

Embodiment 2. A hydrocarbon composition comprising sulfur between about 30 ppm to about 220 ppm, and aromatics between about 0.2 wt. % to about 3 wt. %, wherein the hydrocarbon composition demonstrated an improvement in lubricant oxidation stability over a hydrocarbon composition having the same amount of paraffins and naphthenes and less than 30 ppm of sulfur and less than 0.2 wt. % aromatics.

Embodiment 3. A hydrocarbon composition comprising: a blend of one or more base stocks and a high-sulfur containing material, wherein each base stock has a kinematic viscosity at 100° C. between about 3.0 cSt and about 12.0 cSt, a viscosity index (VI) between about 80 and about 150, a pour point between about −15° C. and −60° C., a NOACK volatility between about 5.0 wt. % and 15.0 wt. %, a sulfur content between about 0 ppm and 100 ppm, aromatics in amount less than 3.0 wt. %, and an NMR branching index between about 20.6 and 38.3, and the high-sulfur containing material comprises between about 0.01 to 4.5 wt. % sulfur.

Embodiment 4. The hydrocarbon composition of Embodiment 3, wherein the high-sulfur containing material further comprises aromatics between about 3 wt. % to 75 wt. %.

Embodiment 5. The hydrocarbon composition of Embodiment 3, wherein the high-sulfur containing material further comprises aromatics having an amount and distribution as determined by ultraviolet (UV) spectroscopy absorptivity of less than about 37.9 l/g-cm@wavelengths between about 254 nm and about 325 nm.

Embodiment 6. The hydrocarbon composition of Embodiment 3, wherein the hydrocarbon composition comprises between about 30 ppm to about 220 ppm sulfur, and between about 0.2 wt. % to about 3 wt. % aromatics.

Embodiment 7. The hydrocarbon composition of Embodiment 3, wherein the hydrocarbon composition has a weighted piston deposit result between about 4.17 to about 4.85 merits as measured by ASTM D8111 (the Sequence IIIH Test).

Embodiment 8. The hydrocarbon composition of Embodiment 3, wherein the hydrocarbon composition has a viscosity increase at 100° C. is between about 0.1% and 29% as measured by the ASTM D8111 (Sequence IIIH Test).

Embodiment 9. The hydrocarbon composition of Embodiment 3, wherein the hydrocarbon composition has a weighted piston deposit improvement between about 0.2 to about 0.6 merits by ASTM D8111 (the Sequence IIIH Test).

Embodiment 10. The hydrocarbon composition of Embodiment 3, wherein the hydrocarbon composition has a viscosity increase at 100° C. improved by about 70% to about 100% on a relative basis by ASTM D8111 (Sequence IIIH Test).

Embodiment 11. A hydrocarbon composition suitable for use as a lubricant comprising a base stock produced by a separation process or a conversion process, wherein the base stock comprises sulfur between about 30 ppm to about 220 ppm and aromatics between about 0.2 wt. % to about 3 wt. %, wherein the lubricant formulated with the hydrocarbon composition has a viscosity increase at 100° C. is between about 0.10% and 29% and a weighted piston deposit is between about 4.17 to about 4.85 merits, both the viscosity increase and the weighted piston deposit measured by ASTM D8111 (Sequence IIIH Test).

Embodiment 12. The hydrocarbon composition of Embodiment 11, wherein the conversion process is catalytic hydrocracking or hydrotreating.

Embodiment 13. The hydrocarbon composition of Embodiment 11, wherein the separation process includes the step of solvent extraction.

Embodiment 14. The hydrocarbon composition of any one of the preceding Embodiments, wherein sulfur is selected from heterocyclic sulfur compounds comprising thiophene and its higher homologs and analogs.

Embodiment 15. The hydrocarbon composition of any one of the preceding Embodiments, wherein the high-sulfur containing material is a refining extract, used oil, or other petroleum streams.

Embodiment 16. The hydrocarbon composition of any one of the preceding Embodiments, wherein the base stock comprises a Group II base stock.

Embodiment 17. The hydrocarbon composition of any one of the preceding Embodiments, wherein the base stock comprises a Group III base stock.

Embodiment 18. The hydrocarbon composition of any one of the preceding Embodiments, wherein the base stock comprises PAO.

Embodiment 19. The hydrocarbon composition of any one of the preceding Embodiments, wherein the aromatics comprise 3+ ring aromatics.

Embodiment 20. The hydrocarbon composition of any one of the preceding Embodiments, wherein the aromatics comprise 4+ ring aromatics.

Embodiment 21. The hydrocarbon composition of any one of the preceding Embodiments, wherein the base stocks are further blended with at least one additive.

Embodiment 22. The hydrocarbon composition of Embodiment 21, wherein the additive comprises an ILSAC GF-6 additive.

Embodiment 23. The hydrocarbon composition of any one of the preceding Embodiments, wherein the hydrocarbon composition comprises between about 80 wt. % to about 98 wt. % base stock and about 2 wt. % to about 20 wt. % additives.

The present invention has been described above with reference to numerous embodiments and specific examples. Many variations will suggest themselves to those skilled in this art in light of the above detailed description. All such obvious variations are within the full intended scope of the appended claims.

What is claimed is:

1. A hydrocarbon composition comprising:

a blend of one or more base stocks and a high-sulfur containing material, wherein each base stock has a kinematic viscosity at 100°° C. between about 3.0 cSt and about 12.0 cSt, a viscosity index (VI) between about 80 and about 150, a pour point between about −15° C. and −60° C., a NOACK volatility between about 5.0 wt. % and 15.0 wt. %, a sulfur content between about 0 ppm and 100 ppm, aromatics in amount less than 3.0 wt. %, an NMR branching index between about 20.6 and 38.3, the sulfur containing material comprises between about 0.01 to 4.5 wt. % sulfur, and the sulfur containing material comprises at least one material selected from the group consisting of vacuum gas oils, raffinates, bright stocks, heavy neutral base stocks, process oils, used lubricants, lubricant extracts, extracts from hydrofinishing, distillate aromatic extracts. and combinations thereof.

2. The hydrocarbon composition of claim 1, wherein the sulfur containing material further comprises aromatics between about 3 wt. % to 75 wt. %.

3. The hydrocarbon composition of claim 1, wherein the hydrocarbon composition comprises between about 30 ppm to about 220 ppm sulfur, and between about 0.2 wt. % to about 3 wt. % aromatics.

4. The hydrocarbon composition of claim 1, wherein the hydrocarbon composition has a weighted piston deposit result between about 4.17 to about 4.85 merits as measured by ASTM D8111 (the Sequence IIIH Test).

5. The hydrocarbon composition of claim 1, wherein sulfur is selected from highly aromatic sulfur compounds and heterocyclic sulfur compounds comprising at least one selected from the group consisting of thiophene, thiophene homologs, and thiophene analogs.

6. The hydrocarbon composition of claim 1, wherein the hydrocarbon composition has a viscosity increase at 100° C. improved by about 70% to about 100% on a relative basis by ASTM D8111 (Sequence IIIH Test).

7. The hydrocarbon composition of claim 1, wherein the hydrocarbon composition has a weighted piston deposit improvement between about 0.2 to about 0.6 merits as compared to a similar mixture not containing sulfur comprising compounds described in claim 5 by ASTM D8111 (the Sequence IIIH Test).

8. The hydrocarbon composition of claim 1, wherein the sulfur containing material is a refining extract, used oil, or other petroleum streams.

9. The hydrocarbon composition of claim 1, wherein the base stock comprises a Group III base stock.

10. The hydrocarbon composition of claim 1, wherein the aromatics comprise 3+ ring aromatics.

11. The hydrocarbon composition of claim 1, wherein the aromatics comprise 4+ ring aromatics.

12. The hydrocarbon composition of claim 1, wherein the base stocks are further blended with at least one additive.

13. The hydrocarbon composition of claim 12, wherein the additive comprises an ILSAC GF-6 additive.

14. The hydrocarbon composition of claim 1, wherein the hydrocarbon composition comprises between about 80 wt. % to about 98 wt. % base stock and about 2 wt. % to about 20 wt. % additives.

* * * * *